US011613932B2

(12) United States Patent
Saebo et al.

(10) Patent No.: US 11,613,932 B2
(45) Date of Patent: Mar. 28, 2023

(54) PIPE HANDLING SYSTEM AND METHOD

(71) Applicant: Schlumberger Technology Corporation, Sugar Land, TX (US)

(72) Inventors: Glenn Thore Saebo, Kristiansand (NO); Rune Skibsrud, Bygland (NO); Kristian Tindvik, Kristiansand (NO); Dag Holen, Kristiansand (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/413,084

(22) PCT Filed: Dec. 9, 2019

(86) PCT No.: PCT/US2019/065267
§ 371 (c)(1),
(2) Date: Jun. 11, 2021

(87) PCT Pub. No.: WO2020/123399
PCT Pub. Date: Jun. 18, 2020

(65) Prior Publication Data

US 2022/0025715 A1 Jan. 27, 2022

Related U.S. Application Data

(60) Provisional application No. 62/778,197, filed on Dec. 11, 2018.

(51) Int. Cl.
*E21B 19/14* (2006.01)
*E21B 15/00* (2006.01)
(Continued)

(52) U.S. Cl.
CPC ..... *E21B 15/003* (2013.01); *E21B 15/00* (2013.01); *E21B 19/087* (2013.01); *E21B 19/14* (2013.01); *E21B 19/24* (2013.01)

(58) Field of Classification Search
CPC ..... E21B 15/003; E21B 15/02; E21B 19/087; E21B 19/14; E21B 19/24
See application file for complete search history.

(56) References Cited

U.S. PATENT DOCUMENTS 3,404,741 A 10/1968 Aldea
4,274,778 A 6/1981 Putnam et al.
(Continued)

FOREIGN PATENT DOCUMENTS

DE 102009043081 A1 3/2011
EP 0472583 A1 3/1992
(Continued)

OTHER PUBLICATIONS

Search Report and Written Opinion of International Patent Application No. PCT/US2019/065267 dated Mar. 27, 2020; 13 pages.
(Continued)

*Primary Examiner* — Taras P Bemko
(74) *Attorney, Agent, or Firm* — Kelly McKinney

(57) ABSTRACT

A pipe racking system including two mechanical arms to move pipe stands to a dedicated position on a rig floor wherein at least one mechanical arm is connected to a mast of a drilling rig. A method to move a drilling rig comprising: providing a pipe racking system with two mechanical arms connected to the mast of the drilling rig; folding the pipe racking system onto the mast of the drilling rig; and transporting the drilling rig without disassembling the pipe racking system from the mast.

16 Claims, 12 Drawing Sheets

(51) Int. Cl.
*E21B 19/087* (2006.01)
*E21B 19/24* (2006.01)

(56) References Cited

U.S. PATENT DOCUMENTS

| | | | | |
|---|---|---|---|---|
| 6,220,807 | B1 | 4/2001 | Sorokan | |
| 7,246,983 | B2 | 7/2007 | Zahn et al. | |
| 8,317,448 | B2 | 11/2012 | Hankins et al. | |
| 9,752,395 | B2 | 9/2017 | Roodenburg et al. | |
| 11,041,346 | B2 | 6/2021 | Mikalsen et al. | |
| 2004/0206551 | A1* | 10/2004 | Carriere | E21B 19/22 175/203 |
| 2006/0104747 | A1 | 5/2006 | Zahn et al. | |
| 2008/0217067 | A1 | 9/2008 | Ge | |
| 2011/0120730 | A1 | 5/2011 | Clasen et al. | |
| 2012/0020758 | A1 | 1/2012 | Springett et al. | |
| 2013/0327543 | A1* | 12/2013 | Reddy | E21B 19/083 166/85.1 |
| 2014/0202769 | A1 | 7/2014 | Magnuson | |
| 2015/0232272 | A1 | 8/2015 | Magnuson | |
| 2015/0259984 | A1* | 9/2015 | Taggart | E21B 7/023 175/57 |
| 2015/0330162 | A1 | 11/2015 | Magnuson et al. | |
| 2016/0010323 | A1 | 1/2016 | Konduc et al. | |
| 2016/0168929 | A1 | 6/2016 | Magnuson et al. | |
| 2016/0201408 | A1 | 7/2016 | Little et al. | |
| 2017/0096866 | A1 | 4/2017 | Magnuson | |
| 2017/0241126 | A1 | 8/2017 | Konduc et al. | |
| 2017/0335591 | A1 | 11/2017 | Konduc et al. | |
| 2019/0003269 | A1 | 1/2019 | Skjaerseth et al. | |

FOREIGN PATENT DOCUMENTS

| | | | |
|---|---|---|---|
| WO | 2013169700 | A1 | 11/2013 |
| WO | 2017025577 | A1 | 2/2017 |
| WO | 2018045059 | A1 | 3/2018 |
| WO | 2020123399 | A1 | 6/2020 |
| WO | 2020123494 | A1 | 6/2020 |

OTHER PUBLICATIONS

Search Report and Written Opinion of International Patent Application No. PCT/US2019/065463 dated Apr. 3, 2020; 11 pages.
"Vertical Pipe Handling", MHWirth, Aug. 2017, Rev. 2, 2 pages.

* cited by examiner

PIPE HANDLING SYSTEM AND METHOD

REFERENCE TO RELATED APPLICATION

This application claims the benefit of and incorporates by reference U.S. Provisional Patent Appl. Ser. No. 62/778,197 filed on Dec. 11, 2018.

TECHNICAL FIELD

The present disclosure relates to pipe handing equipment used on various rigs, such as land rigs. More specifically, the present disclosure relates to equipment used to perform vertical drilling tubular handling operations on a drill floor.

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

Drilling tubulars include drill pipe, tubing, and casing ("tubulars") which are assembled by threading one section of tubular to the next. Management of tubulars on the drill floor is conducted by various vertical pipe handling components and features that retrieve tubular, position the tubular into the mousehole, and tighten one tubular to the next. Offshore, automatic pipe handling systems may comprise a column racker, which is a separate column with two or three arms, leading to space requirements on the drillfloor. These rackers have proven to be very efficient. And while the installation of the large column may not be straight forward, the pipe handling system is only installed once. On the contrary, a land rig moves frequently and handling an additional column results in extra rig-up time during a rig move. In addition, these steps require significant human intervention in a hazardous environment.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments, a system is described for handling drilling pipe on a drilling rig having a mast. The system includes: an upper mechanical arm including a pipe gripper disposed at a distal end of the upper arm, the upper arm at a proximal end being fixed to the mast of the drilling rig; and a lower mechanical arm including a pipe gripper disposed at a distal end of the lower arm, the lower arm at a proximal end being fixed to the mast at a location below the upper arm. The drilling rig is configured for land drilling operations, and the upper and lower arms are configured to be transported without disassembly from the mast during transportation between land drilling locations.

According to some embodiments, the upper mechanical arm and its pipe gripper are configured to grip a stand of drilling pipe and support its load during movement, and the lower mechanical arm and its pipe gripper are configured to guide the stand of drilling pipe during the movement. According to some embodiments, both upper and lower mechanical arms are configured to alternatively act as guide arms during the stand of drilling pipe moves.

According to some embodiments, the drilling rig includes an upper horizontal platform mounted to the mast and the upper mechanical arm is mounted to the upper horizontal platform at its proximal end. The upper horizontal platform can be a fingerboard that includes a plurality of elongated fingers between which a plurality of drilling pipes can be stored. The proximal end of the upper mechanical arm can be mounted to the underside of the fingerboard. According to some embodiments, the proximal end of the upper mechanical arm can be mounted to a trolley moveable upon rails mounted to the underside of the fingerboard.

According to some embodiments, the upper mechanical arm can be configured to fold against the upper horizontal platform to facilitate transportation of the drilling mast without disassembly from the mast, the upper mechanical arm and the upper horizontal platform being parallel or near parallel to the mast when fully folded.

According to some embodiments, the drilling rig includes a lower horizontal platform mounted to the mast below the upper horizontal platform and the lower mechanical arm is mounted to the lower horizontal platform at its proximal end. The lower horizontal platform can be a belly board including a plurality of elongated fingers between which a plurality of drilling pipe can be stored, the proximal end of the lower mechanical arm being mounted to the underside of the belly board. The lower mechanical arm can be configured to fold against the lower horizontal platform to facilitate transportation of the drilling mast without disassembly from the mast.

According to some embodiments, a method is described to move a drilling rig between two land drilling locations. The method includes: providing a pipe racking system comprising at least one mechanical arm, wherein the arm is connected to a mast of the drilling rig; folding the pipe racking system onto the mast of the drilling rig; and transporting the drilling rig without disassembling the pipe racking system from the mast.

According to some embodiments, the pipe racking system further includes a second mechanical arm connected to the mast. The drilling rig can include upper and lower horizontal platforms, with one mechanical arm being mounted on the underside of the upper horizontal platform and a second mechanical arm being mounted to the underside of the lower horizontal platform. The mechanical arms can be folded against the upper and lower horizontal platforms, and the upper and lower horizontal platforms can be folded towards the mast.

BRIEF DESCRIPTION OF THE DRAWINGS

The subject disclosure is further described in the following detailed description, and the accompanying drawing and schematic of non-limiting embodiment of the subject disclosure. The features depicted in the figure are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
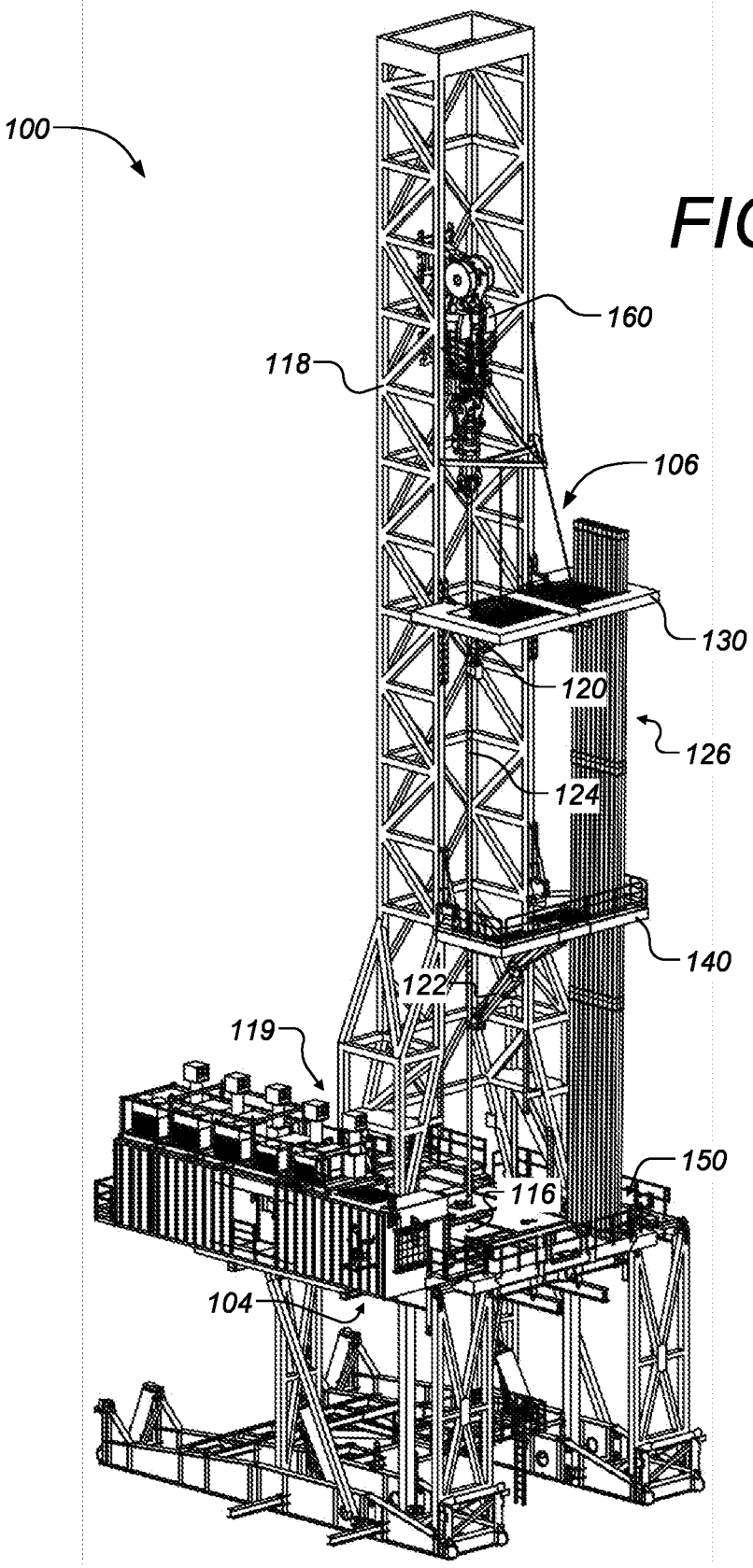
FIG. 1 is a perspective view of a drilling rig that includes a pipe handling system, according to some embodiments.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Like reference numerals are used herein to represent identical or similar parts or elements throughout several diagrams and views of the drawings.

FIG. 1 is a perspective view of a drilling rig that includes a pipe handling system, according to some embodiments. The drilling rig 100 is configured for drilling and tripping and includes equipment to drill a subterranean wellbore used for exploration of and/or production of hydrocarbon-bearing fluid from subterranean rock formations. In this case, drilling rig 100 includes a mast 118, drill floor 119, drilling control room (DCR) 104, draw works (not visible), top drive 160 and pipe handling system, generally shown as 106. From DCR 104, various equipment and tools of rig 100 are monitored and controlled. Pipe handling system 106 is used to handle drilling tubulars 126 (e.g. drill pipe, tubing, and/or casing) which is shown racked in fingerboard 130 and belly board 140. Tubulars 126 are supported by setback on the drill floor 119. Upper racking arm 120 is shown gripping a drilling tubular 124 near its upper end.

In this example shown in FIG. 1, pipe handling system 106 includes two arms, upper arm 120 and lower arm 122 configured to lift and guide drilling tubulars 126 as needed in the drilling operation, such as: racking stands, building stands in the mousehole, picking up singles from the catwalk, laying out singles to the catwalk, handling BHA, and tripping in and out of the fingerboard. Arms 120 and 122 are shown in FIG. 1 handling a drilling tubular 124 above the well center 116 on drill floor 119. The rig may also comprise pressure control equipment such as one or more Blowout Preventers (BOPS) to control pressure of the well and a manifold system to direct and manage fluids to and from mud pumps.

It has been found to be beneficial to reduce the amount of risky manual operations as required using conventional pipe racking systems on land rigs during tripping by automating the systems and process. According to some embodiments, the pipe handling system 106 includes a known land rig manual pipe racking arrangement as a backup in the case that the automatic pipe handling system has down time. According to some embodiments, the pipe racking system does not have any components on the elevation of the drill floor 119. The lack of components on the drill floor 119 enables a traditional drill floor arrangement, i.e. catwalk to serve the drill floor in the setback alley. The lack of racking components on drill floor also saves space and reduces risk for drill floor personnel by optimizing visibility and maximizing available drill floor room. According to some embodiments, the architecture of the pipe handling system 106 facilitates portability and movability of the entire rig 100, since the system components are included in a compact way in the existing fingerboard and belly board modules.

Figure 2:
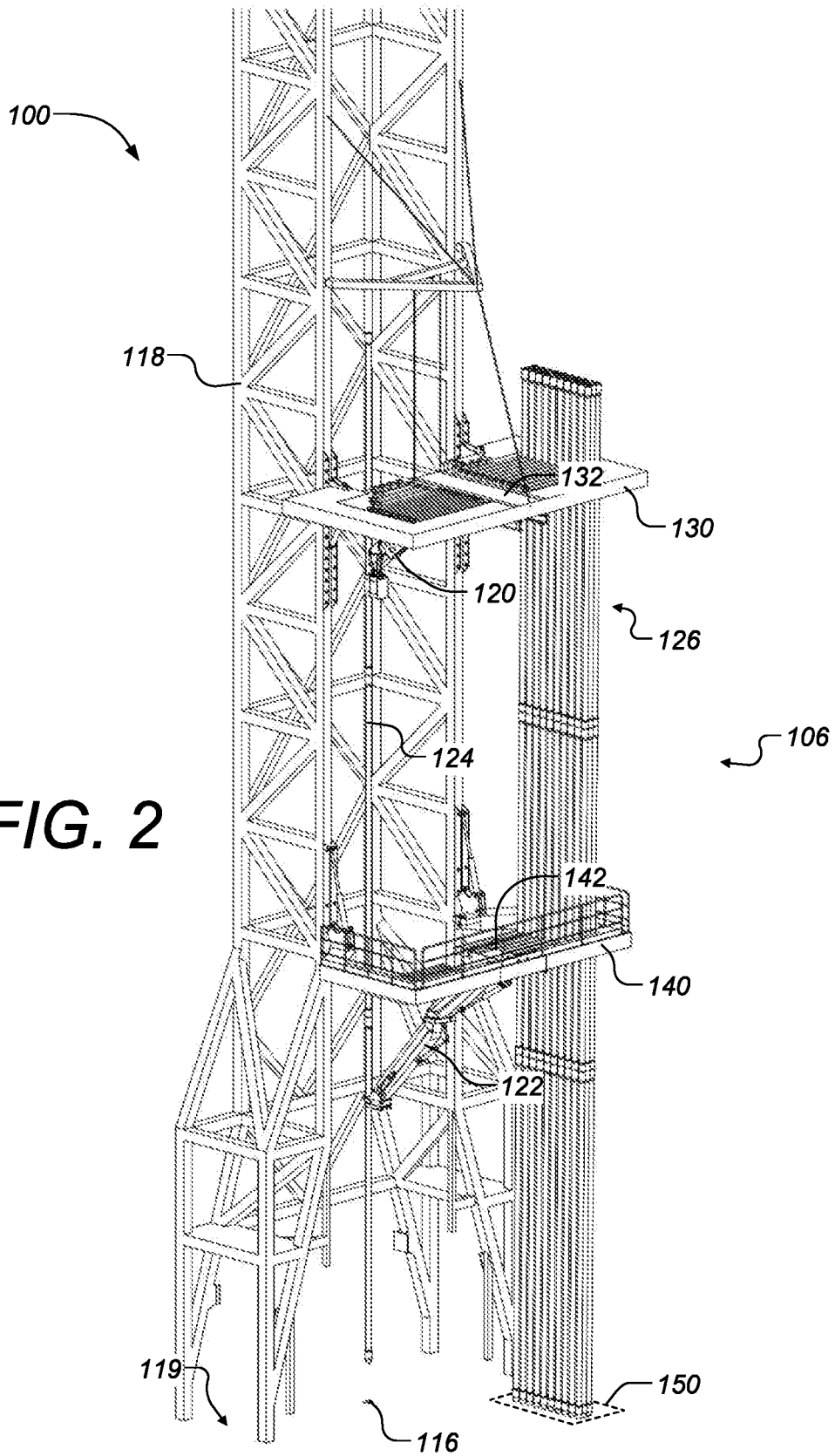
FIG. 2 is a perspective view of a portion of drilling rig that includes a pipe handling system, according to some embodiments.

FIG. 2 is a perspective view of a portion of a drilling rig that includes a pipe handling system, according to some embodiments. As shown, the upper moving mechanical arm 120 is suspended under a "diving board" of fingerboard 130, and the lower moving mechanical arm 122 is suspended under a "diving board" of belly board 140. The pipe handling system 106 moves pipe stands from the fingerboard 130 either to a dedicated hand off position or to the well center 116 for stabbing or vice versa. According to some embodiments, the pipe handling system 106 is configured to transfer stands to and from the setback 150 by two hydraulic arms below the "diving boards" platforms 132 and 142 of fingerboard 130 and belly board 140 respectively. As illustrated in FIG. 2, the two arms 120 and 122 of system 106 are connected to the mast 118 rather than to a separate column. According to some embodiments, the upper arm 120 is configured as a racking arm, and lower arm 122 is configured as guiding and tail-in arm. According to some embodiments, the arrangement of upper and lower arms 120 and 122 respectively provide adequate pipe handing functionally without the need for any additional machines on drill floor 119. Providing automated pipe handing capability without added machinery on drill floor 119 has been found to be beneficial for overall safety.

Figure 3:
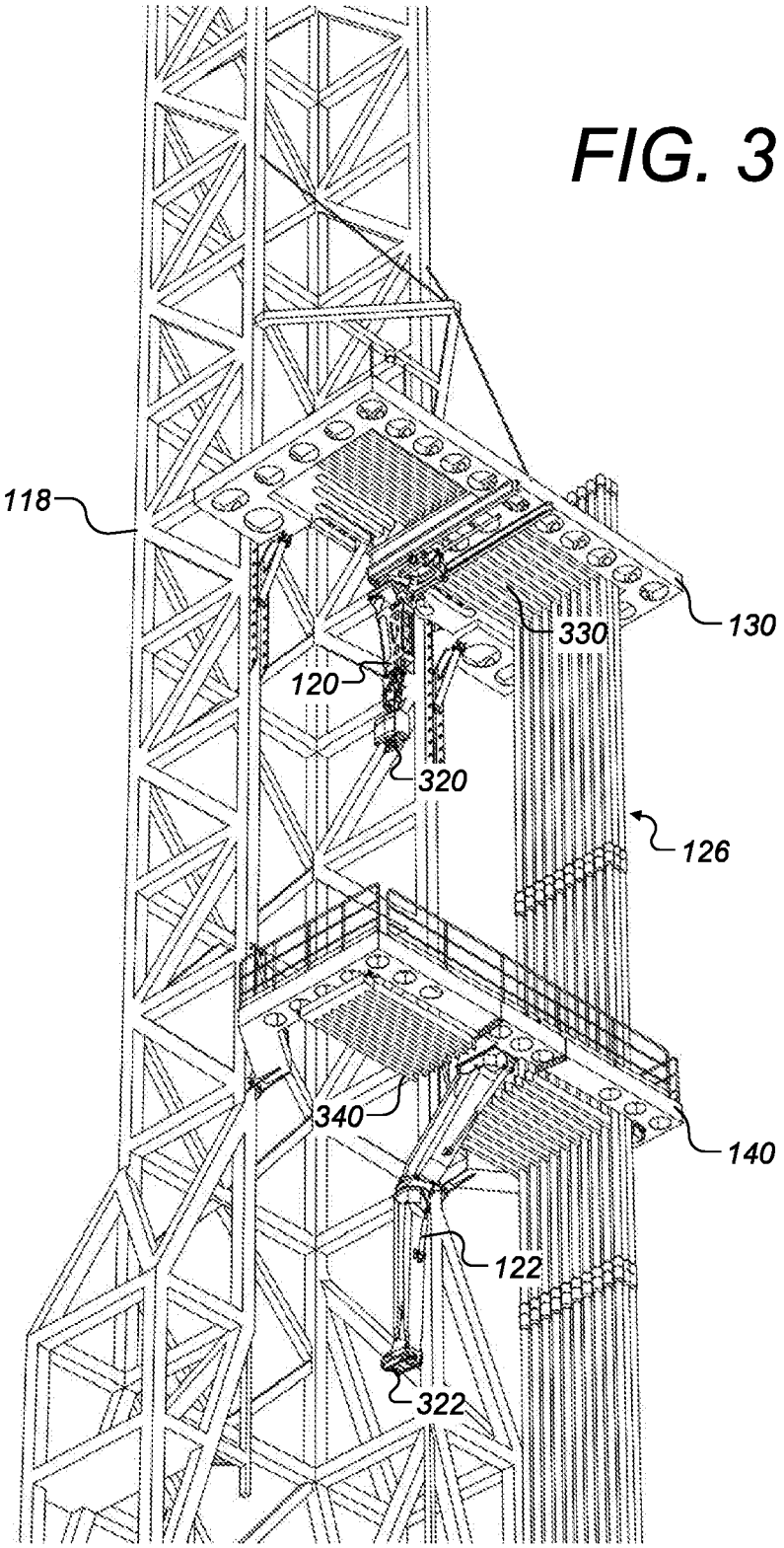
FIGS. 3 and 4 are perspective views illustrating further details of a pipe handling system, according to some embodiments.
Figure 4:
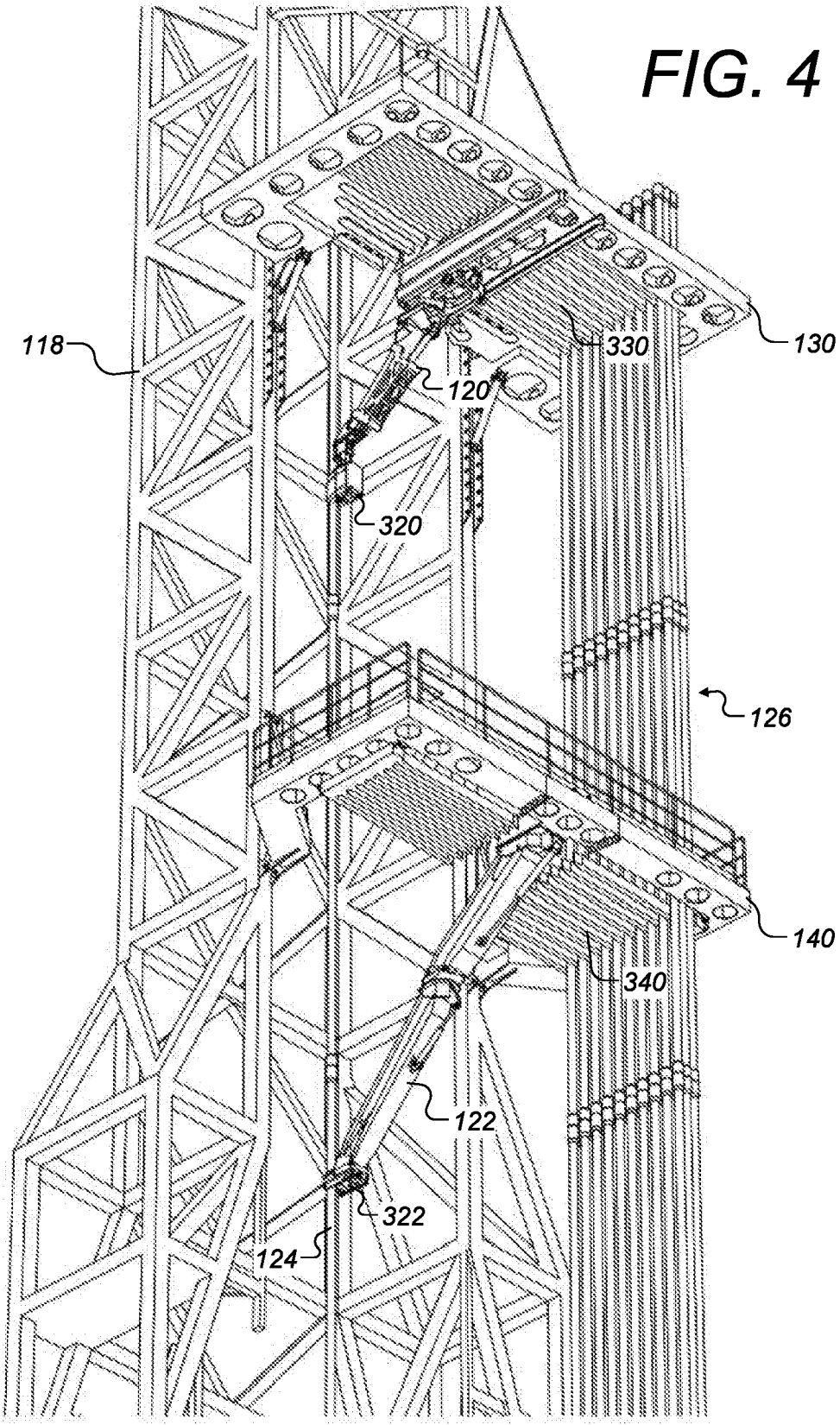

FIGS. 3 and 4 are perspective views illustrating further details of a pipe handling system, according to some embodiments. A gripper 320 is disposed at the distal end of upper arm 120 and a gripper 322 is disposed at the distal end of lower arm 122. According to some embodiments, gripper 320 of upper racking arm 120 is configured to grip a drilling tubular and carry its load, while the gripper 322 of lower racking arm 122 is configured for guiding a drilling tubular being carried by the upper arm 120. This arrangement may enable manual backup racking with a minimum of drill floor obstruction. According to some embodiments, the upper arm 120 and gripper 320 is configured with a load lifting capability. The lower arm 122 is configured primarily as a guide arm that follows the same path as the upper arm 120 to keep the stand vertical. For example, in FIG. 4, a drilling pipe 124 is shown being gripped by grippers 320 and 322 and is shown in a substantially vertical position. According to some embodiments, a controlled lean angle to the stand being gripped by grippers 320 and 322 can be programmed when desired. According to some other embodiments, the pipe handling system can be configured to operate in different "modes" depending on the load requirements. For example, in a "standard" mode the arms 120 and 122 are able to simultaneously lift and guide pipes up to a specified weight (e.g. 2.5 tons), and in a "heavy" mode the pipe stand weight might be carried by either the drill floor or the top drive, and the arms 120 and 122 are configured primarily as guide arms that is similar to a conventional manual movement sequence.

Figure 5:
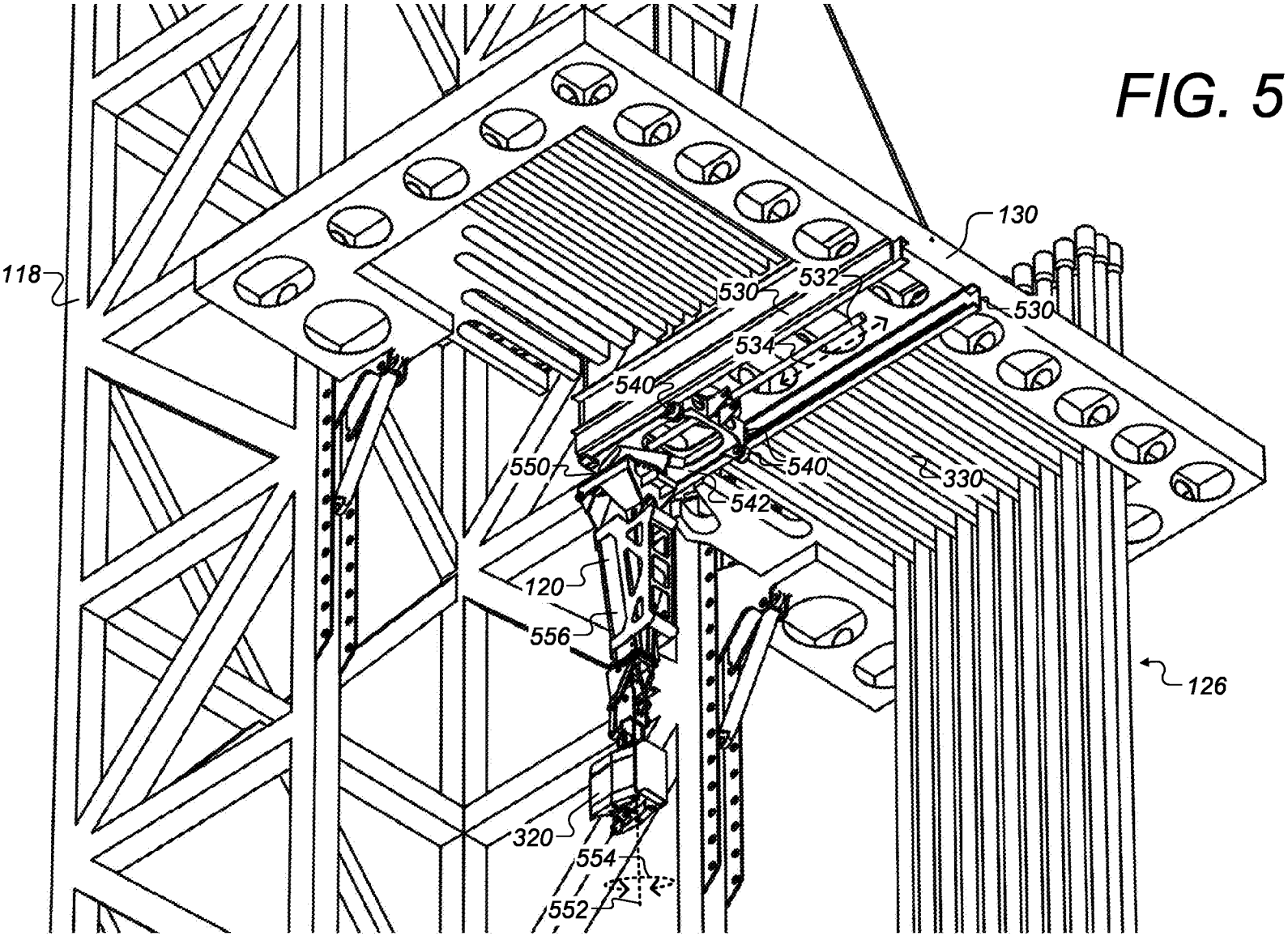
FIGS. 5 and 6 are perspective views illustrating further details of upper and lower arms, respectively, of a pipe handling system, according to some embodiments.
Figure 6:
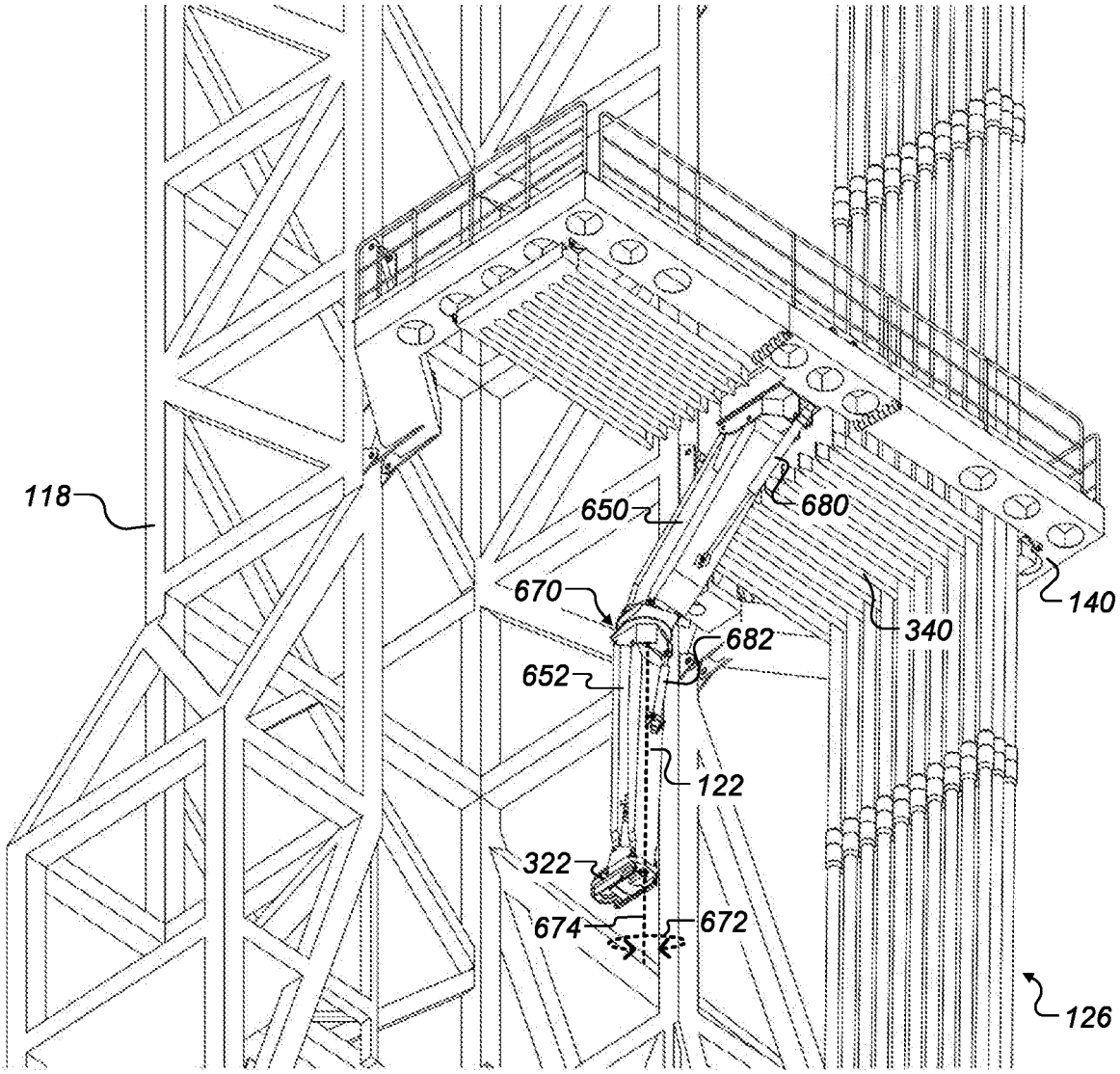

FIGS. 5 and 6 are perspective views illustrating further details of upper and lower arms, respectively, of a pipe handling system, according to some embodiments. In FIG. 5 the upper racking arm 120 includes tilt and telescope cylinders to move the arm 120 and gripper 320 through its desired range of motion. According to some embodiments, arm 120 is mounted on a trolley 524 that travels along rails 530 on wheels 540 of trolley 524. Motion of trolley 542 along rails 530, as indicated by dashed arrow 554, can be provided by a hydraulic cylinder 532. According to some embodiments, wheels 540 might be protected from overloading in cases where the arms are configured to carry heavy loads. For example, in the case of overloading, the end plates of the trolley 542 can be configured to transfer the surplus load to the rails 530 by direct contact. According to some embodiments, even during such overload circumstances, the pipe racking system can still be able to provide for some movement of the tubulars. Also shown in FIG. 5 is a rotatable joint 550 that provide rotation of the link 556 of arm 120 about a vertical axis 552 as shown by arrow 554.

In FIG. 6, the lower arm 122, in this example, is shown with an upper link 650 and lower link 652. An "elbow" joint 670 is configured to provide rotation of the lower link 652 relative to upper link 650 about axis 674 as shown by arrow 672. Also visible are cylinders 680 and 682 that are configured to facilitate actuation of the links 650 and 652.

According to some embodiments, the widths of the upper arm 120 and lower arm 122 are limited to the width of the gripper heads 320 and 322, respectively. The widths of the gripper heads 320 and 322 and arms 120 and 122 can be limited such that the arms and grippers can reach pipes in all or more locations within the fingers 330 and 340, despite other pipes being located between adjacent fingers (i.e. even with "full" fingers on each side). Such capability provides additional freedom for racking order of pipe stands and provides freedom to fill and sort individual fingers with special pipes.

Figure 7:
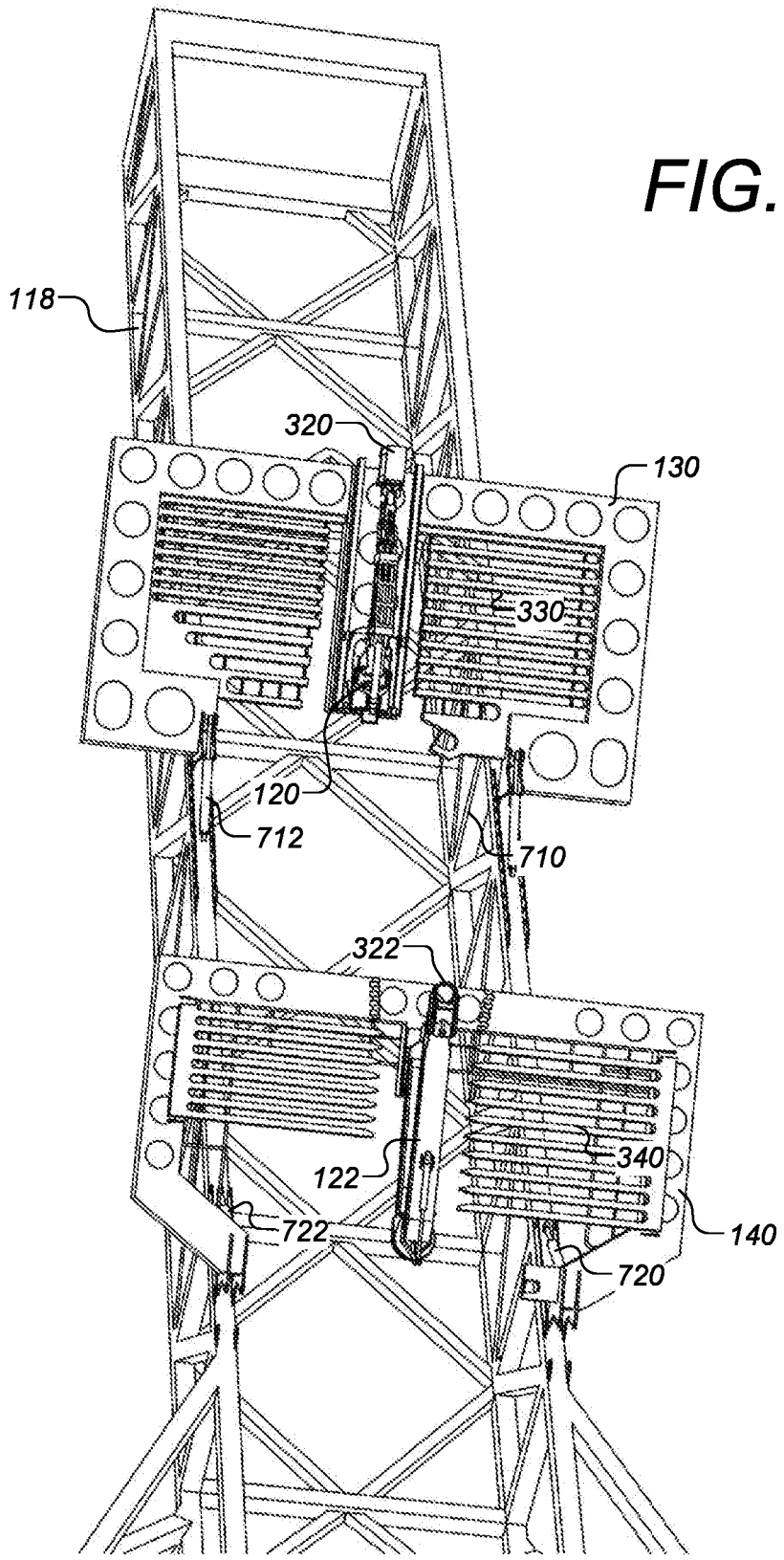
FIGS. 7, 8 and 9 are perspective views illustrating further details of the fingerboard, belly board, upper arm and lower arm in a partially folded state in preparation for transport, according to some embodiments.
Figure 8:
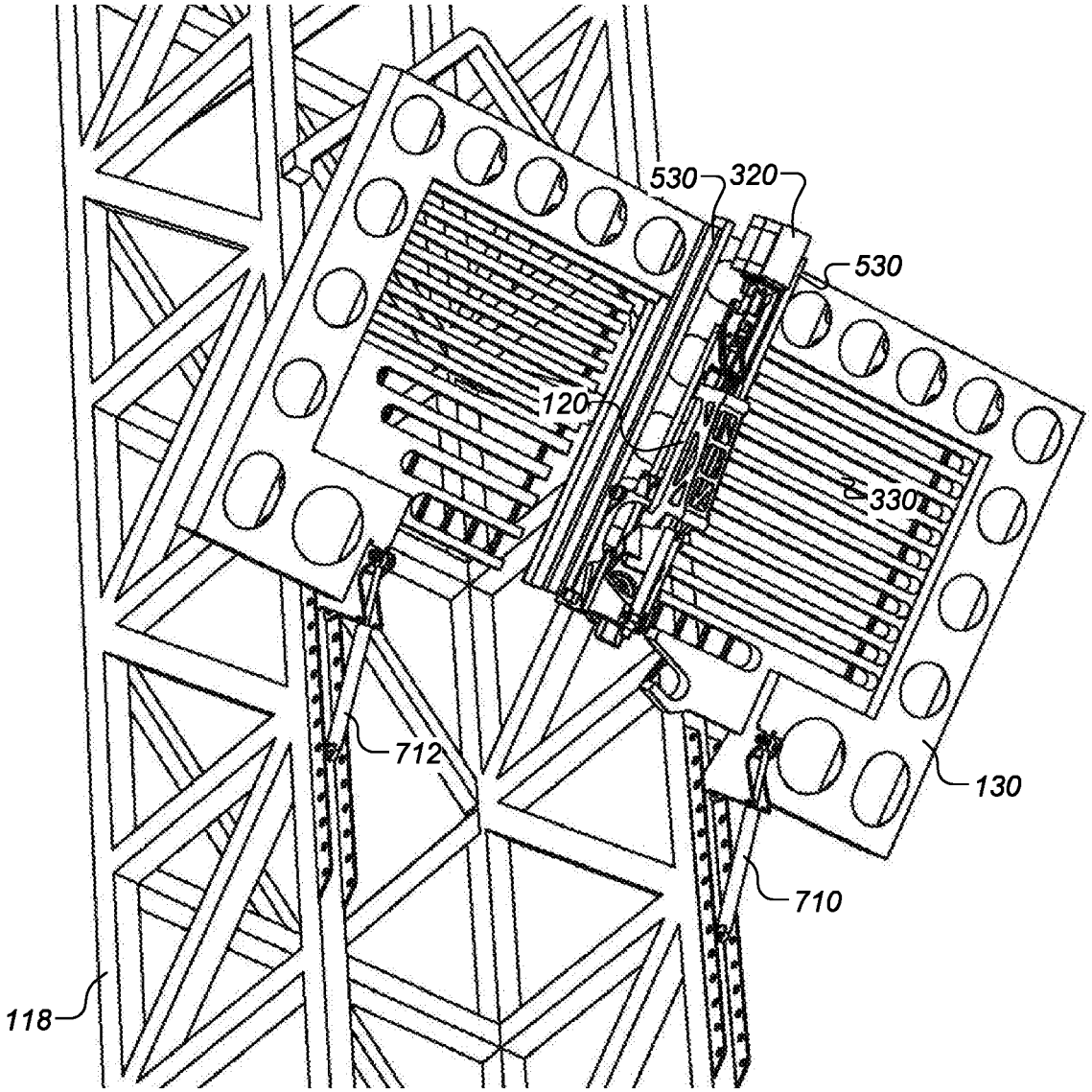
Figure 9:
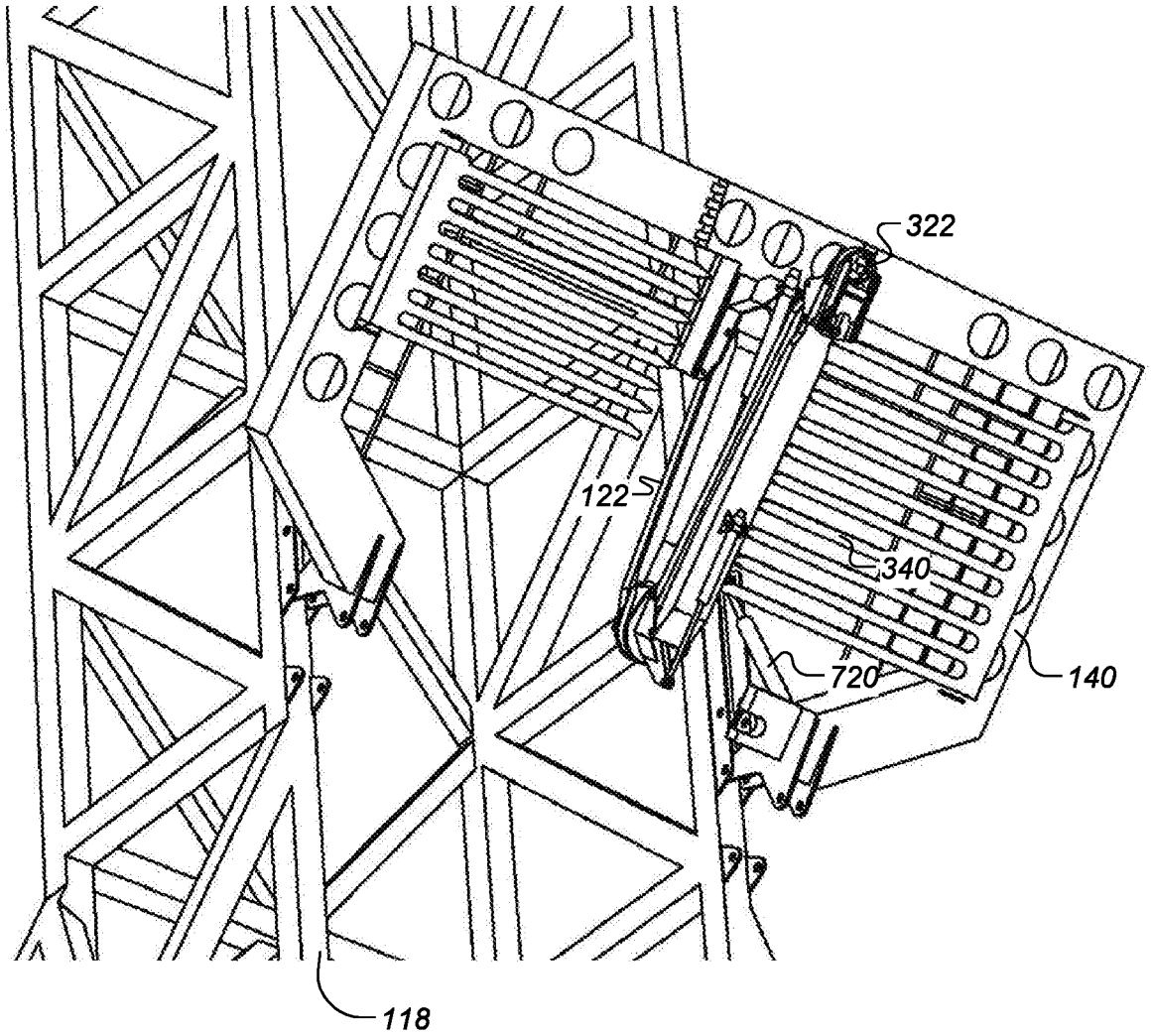

According to some embodiments, the arms 120 and 122 are configured to fold along with the fingerboard 130 and belly board 140 for ease of rig-down, transport and rig-up operations. FIGS. 7, 8 and 9 are perspective views illustrating further details of the fingerboard, belly board, upper arm and lower arm in a partially folded state in preparation for transport, according to some embodiments. FIG. 7 shows the finger and belly boards partially folded against mast 118. Visible are cylinders 710, 712, 720 and 722 that can be configured to actuate the folding process. In some cases, air springs can be included to counter the weight of the fingerboard 130 and belly board 140. FIGS. 8 and 9 show further details of the upper and lower arms being folded, respectively. According to some embodiments, the upper and lower arms 120 and 122 can be folded to vertical position being flat (or nearly flat) against the fingerboard 130 and belly board 140, respectively. In the case of the upper arm 120, the folding can include the open end of gripper 320 being located between rails 530 as shown in FIG. 8, which can aid in protecting the gripper head 320 during transport, rig-up and rig-down operations by limiting exposure to any impact.

Figure 10:
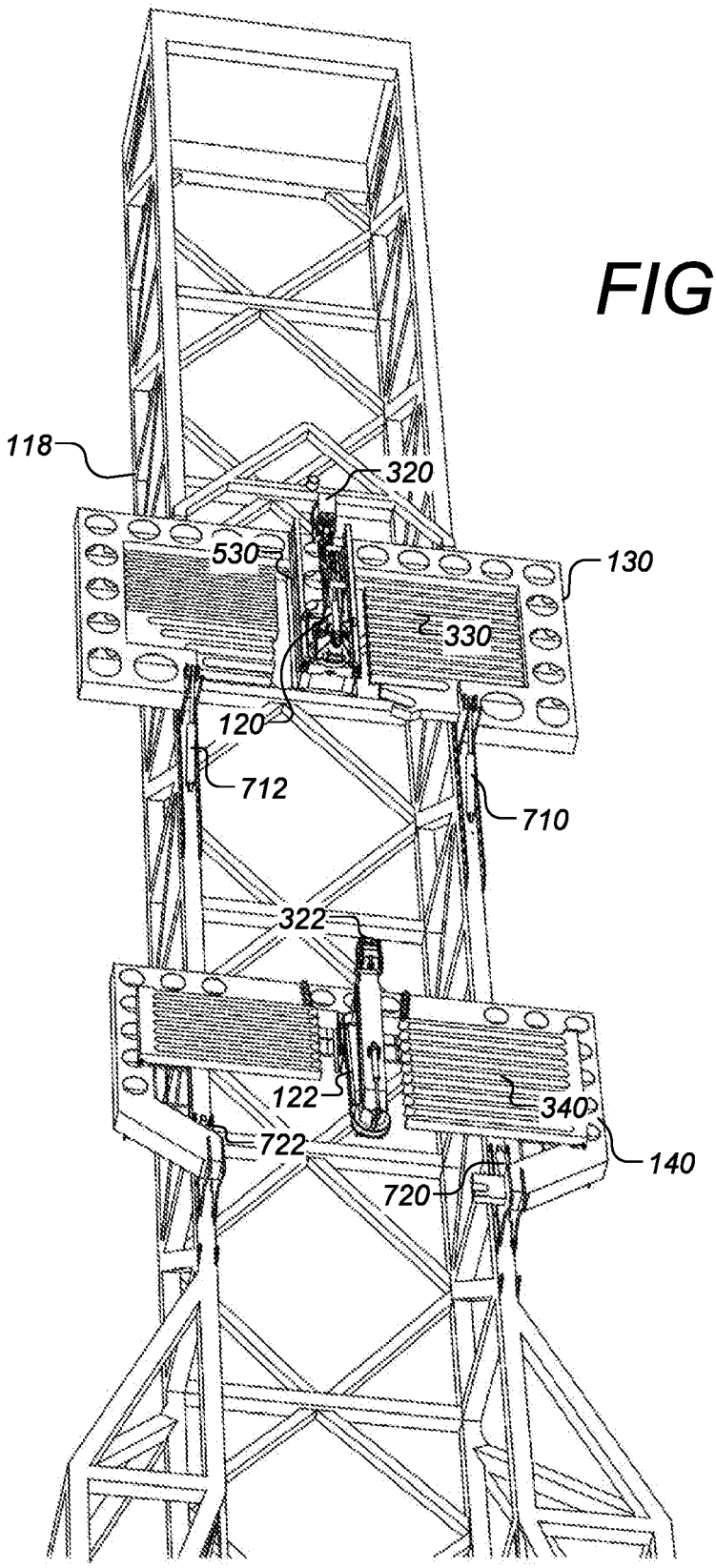
FIGS. 10, 11 and 12 are perspective views illustrating further details of the fingerboard, belly board, upper arm and lower arm in a fully folded state in preparation for transport, according to some embodiments.
Figure 11:
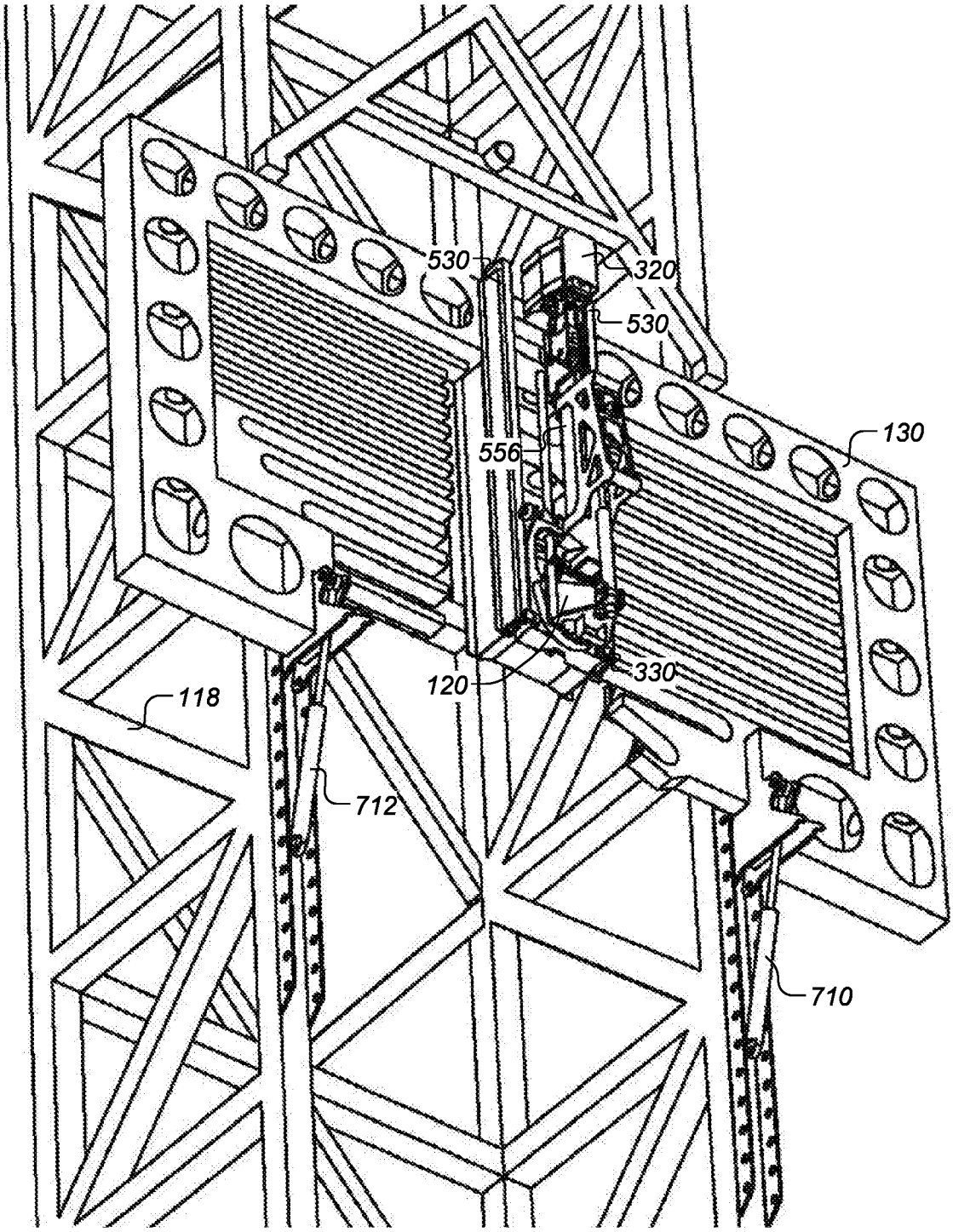
Figure 12:
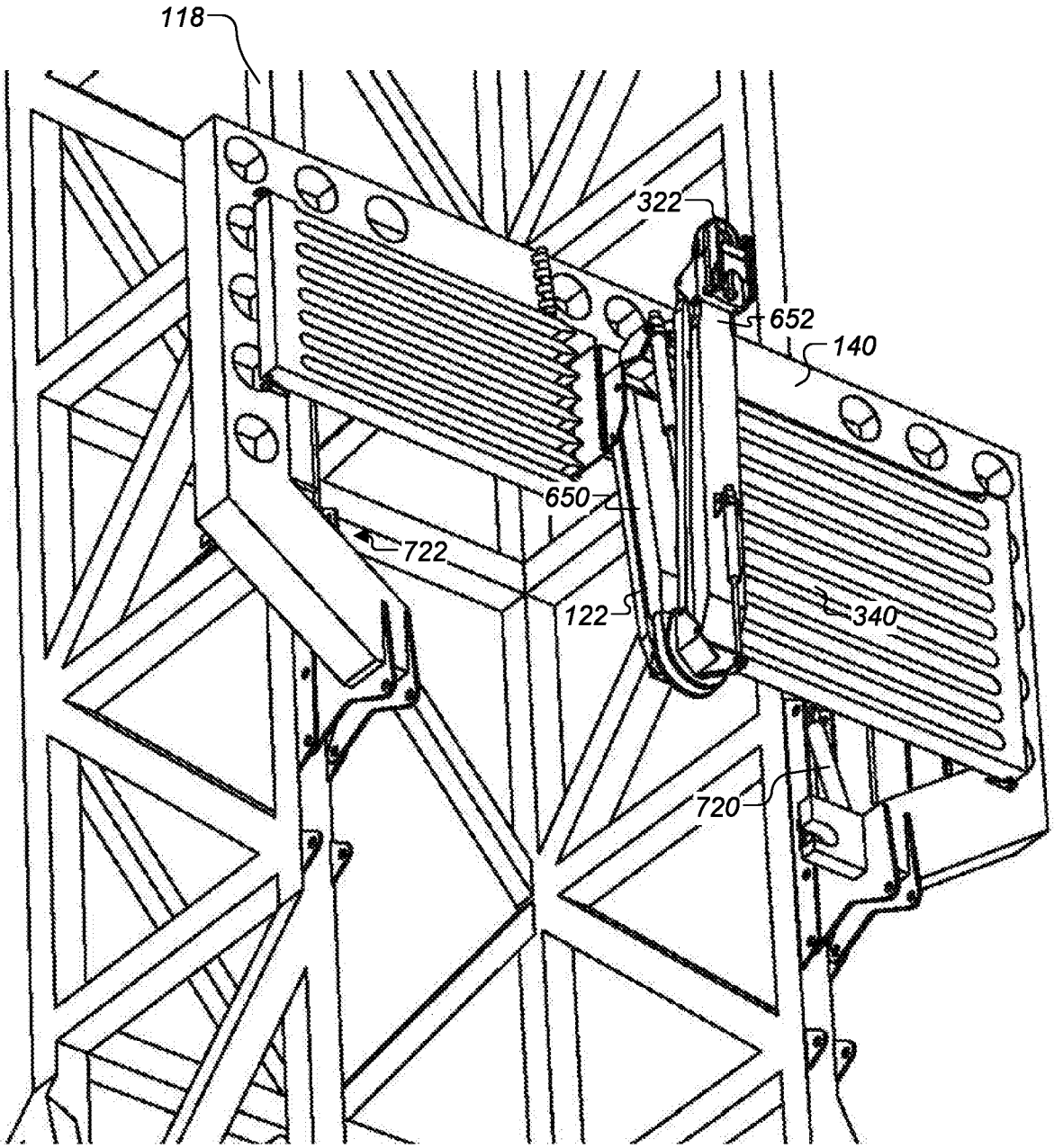

FIGS. 10, 11 and 12 are perspective views illustrating further details of the fingerboard, belly board, upper arm and lower arm in a fully folded state in preparation for transport, according to some embodiments. FIG. 10 shows the finger and belly boards partially folded against mast 118. FIGS. 11 and 12 show further details of the upper and lower arms in fully folded states, respectively. Note that when fully folded, the arm link 556 of upper arm 120 is parallel or nearly so with the mast 118. Similarly, the arm links 650 and 652 of lower arm 122 are parallel or nearly so with the mast 118. By providing the ability to fold the upper and lower arms with the respective boards, the pipe handling system can be transported along with the boards and drilling mast without having to remove or otherwise disassemble the arms from the boards or mast. It has been found that folding the upper and lower arms along with the finger and belly boards and transporting said components without disassembly provides increased efficiency as well as cost and time savings for the rig-down, transport and rig-up procedures. It has also been found that providing the pipe handling system such as described, the other overall drilling rig system can be kept at a relatively low weight, which further aids in transportation.

According to some embodiments, in the case of malfunction, a manual racking process can still be used as an alternative, since the system is configured to be used with traditional setback configuration as shown in FIG. 2.

According to some embodiments, the functions carried out by the pipe racking system may be fully automated with a robotic control system that controls and monitors all operations and protects the column and rig from operator failure. According to some embodiments, a control system can be located in DCR 104 and can be configured to send commands and receive feedback from both the upper and lower racking arms 120 and 122 so that a driller operator might have only a safety monitoring role, or no role at all in the racking sequence. In this case the pipe handling system can be said to be fully automatic.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system for handling drilling pipe on a drilling rig having a mast, the system comprising:

an upper mechanical arm including a pipe gripper disposed at a distal end of the upper mechanical arm, the upper mechanical arm at a proximal end being fixed to the mast of the drilling rig, wherein the drilling rig is configured for land drilling operations and the upper arm is configured to be transported without disassembly from said mast during transportation between land drilling locations, wherein the drilling rig includes an upper horizontal platform mounted to the mast, and the upper mechanical arm is mounted to the upper horizontal platform at the proximal end of the upper mechanical arm, wherein, once mounted, the upper horizontal platform is configured to remain stationary in a vertical direction along the mast, wherein the upper mechanical arm is configured to fold against the upper horizontal platform to facilitate transportation of the mast without disassembly from the mast, and wherein the upper mechanical arm is configured to fold to a vertical position being at least nearly flat against the upper horizontal platform.

2. The system according to claim 1 further comprising:

a lower mechanical arm including a pipe gripper disposed at a distal end of the lower arm, the lower arm at a proximal end being fixed to the mast at a location below said upper arm, and wherein the lower mechanical arm is configured to be transported without disassembly from said mast during transportation between land drilling locations.

3. The system according to claim 2, wherein the upper mechanical arm and the pipe gripper of the upper mechanical arm are configured to grip a stand of drilling pipe and support a load of the stand of drilling pipe during movement, and wherein the lower mechanical arm and the pipe gripper of the upper mechanical arm are configured to guide the stand of drilling pipe during said movement.

4. The system according to claim 3, wherein both upper and lower mechanical arms are configured to alternatively act as a guide arm during the stand of drilling pipe moves.

5. The system according claim 2, wherein the drilling rig includes a lower horizontal platform mounted to said mast below said upper horizontal platform, and wherein said lower mechanical arm is mounted to said lower horizontal platform at the proximal end of the lower mechanical arm.

6. The system according to claim 5, wherein said lower horizontal platform is a belly board, said proximal end of the lower mechanical arm being mounted to an underside of said belly board.

7. The system according to claim 5, wherein said lower mechanical arm is configured to fold against said lower horizontal platform to facilitate transportation of said drilling mast without disassembly from said mast.

8. The system according to claim 1, wherein said upper horizontal platform is a fingerboard including a plurality of elongated fingers between which a plurality of drilling pipes can be stored, said proximal end of the upper mechanical arm being mounted to an underside of said fingerboard.

9. The system according to claim 8, wherein said proximal end of the upper mechanical arm is mounted on a trolley moveable upon rails mounted on said underside of said fingerboard.

10. The system according claim 1, wherein said upper horizontal platform is configured to fold against said mast to facilitate transportation of said mast without disassembly from said mast, said upper mechanical arm and said upper horizontal platform being parallel or near parallel to said mast when fully folded.

11. The system according to claim 1, wherein said upper mechanical arm includes tilt and/or telescope cylinders configured to provide desired range of motion for the upper mechanical arm and the pipe gripper of the upper mechanical arm.

12. The system according to claim 1, wherein said drilling rig is configured to drill a subterranean wellbore used for exploration of and/or production of hydrocarbon-bearing fluid from subterranean rock formations.

13. A method to move a drilling rig between two land drilling locations, the method comprising:

providing a pipe racking system comprising at least one mechanical arm wherein the at least one mechanical arm is connected to a mast of the drilling rig, wherein the drilling rig comprises an upper horizontal platform mounted to the mast, and said at least one mechanical arm is mounted on an underside of the upper horizontal platform, wherein, once mounted, the upper horizontal platform is configured to remain stationary in a vertical direction along the mast;

folding the pipe racking system onto the mast of the drilling rig; and transporting the drilling rig without disassembling the pipe racking system from the mast, wherein the folding step occurs before the transporting step and comprises folding the at least one mechanical arm to a vertical position being at least nearly flat against the upper horizontal platform.

14. The method according to claim 13, wherein the pipe racking system further comprises a second mechanical arm connected to said mast.

15. The method according to claim 13, wherein said drilling rig further comprises a lower horizontal platform, and wherein a second mechanical arm is mounted to an underside of said lower horizontal platform.

16. The method according to claim 15, wherein the folding step further comprises: folding the second mechanical arm against the lower horizontal platform; and folding said upper and lower horizontal platforms towards said mast.

* * * * *